US008342260B2

(12) United States Patent
Buchenau et al.

(10) Patent No.: US 8,342,260 B2
(45) Date of Patent: Jan. 1, 2013

(54) HAND-HELD POWER TOOL WITH SPRING-LOADED HANDLE SUSPENSION

(75) Inventors: Alexander Buchenau, Landsberg (DE); Uto Plank, Freising (DE); Stefan Hammerstingl, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 1172 days.

(21) Appl. No.: 11/639,605

(22) Filed: Dec. 15, 2006

(65) Prior Publication Data

US 2007/0144750 A1 Jun. 28, 2007

(30) Foreign Application Priority Data

Dec. 23, 2005 (DE) ..... 10 2005 000 207

(51) Int. Cl.
*B25D 17/241* (2006.01)

(52) U.S. Cl. ..... 173/162.1; 173/162.2

(58) Field of Classification Search ..... 173/162.1, 173/162.2, 210, 211
See application file for complete search history.

(56) References Cited

U.S. PATENT DOCUMENTS 1,508,623 A * 9/1924 Somervell ..... 173/205
3,063,508 A * 11/1962 Henry ..... 173/118
3,189,104 A * 6/1965 Jamer et al. ..... 173/154
3,561,545 A * 2/1971 Rassieur ..... 173/166
4,576,241 A * 3/1986 Emonet ..... 173/162.2
5,069,600 A * 12/1991 Althaus et al. ..... 417/64
5,921,327 A * 7/1999 Henriksson et al. ..... 173/210

FOREIGN PATENT DOCUMENTS

EP 0033304 8/1981

OTHER PUBLICATIONS

Abstract of Japanese Publication JP 6155331, Jun. 1994.
European Search Report.

* cited by examiner

*Primary Examiner* — Rinaldi Rada
*Assistant Examiner* — Nathaniel Chukwurah
(74) *Attorney, Agent, or Firm* — Abelman, Frayne & Schwab

(57) ABSTRACT

A portable hand-held power tool (2), especially in the form of a drilling or chisel hammer, includes a drive assembly (8) located in the tool housing (10) for driving a tool spindle (4) along an operational axis (A), a first handle (16) which is rotatable around a first pivotal axis (S1) by a first handle suspension (22), a second handle (20) located on the opposite sides (14.1, 14.2) of the housing which is rotatable around a second pivotal axis (S2) by a second handle suspension (24), and spring elements for retaining the handles (16, 20) in their initial position, with the first and second handle suspensions (22, 24) extending partially circumferentially about the drive assembly (8).

8 Claims, 2 Drawing Sheets

HAND-HELD POWER TOOL WITH SPRING-LOADED HANDLE SUSPENSION

BACKGROUND OF THE INVENTION

1. Field of the Invention

The present invention relates to a portable hand-held power tool, especially in the form of a drilling or chisel hammer and including a drive assembly for driving a tool spindle along an operational axis, which comprises a drive assembly in the form of an electric motor and a movement converter in the form of a percussion mechanism, if necessary in combination with a transmission. The drive assembly is located in the tool housing. Further, the hand-held power tool includes a first handle pivotable by a first handle suspension around a first pivotal axis, and a second handle pivotable around a second pivotal axis by a second handle suspension. Both handles extend from the opposite sides of the housing and are respectively held in their initial position by spring means.

2. Description of the Prior Art

Hand-held power tools of the type discussed above generate strong vibrations during operation along the operational axis in the housing. As a result of the spring-loaded handle suspensions, these vibrations are transmitted at considerably reduced intensity to the handles.

From U.S. Pat. No. 4,576,241, a pneumatic chisel and drilling hammer is known in which two handles project from opposite sides of the housing. Both handles are provided at the free ends of levers, pivotally supported at the head of the housing. Furthermore, between the levers and the housing, respective helical springs are provided, which extend parallel to the operational axis, which insulate the corresponding handles from the head of the housing against vibrations acting in the direction of the operational axis.

In this case, the head and the handle assembly are formed as an assembly unit, in order to enable their retrofitting at the existing chisel or drilling hammer.

This type of handle assembly, however, has the disadvantage that the constructional length of the disclosed tool increases considerably at the end remote from the working tool. In particular, with electropneumatic hand-held power tool, which, in addition to a percussion device and, possibly, an additional transmission, also includes a drive motor in the housing, the increased constructional length at the remote end of the housing would result in a very inconvenient form of a hand-held power tool that would not allow comfortable handling.

SUMMARY OF THE INVENTION

An object of the present invention is to avoid the disadvantages discussed above in a portable hand-held power tool with spring-loaded handles, and in particular, to ensure a compact form of a hand-held power tool with an electropneumatic drive.

According to the invention, this and other objects of the present invention, which will become apparent hereinafter, are achieved in that both handle suspensions extend over both spacial axes extending transverse to the operational axis, sectionwise around the drive assembly, i.e., that the first handle suspension and the second handle suspension partially circumferentially surround the drive assembly. For this purpose, the handle suspensions, for example, can include two forked arms or only one bent arm, which extends around the handle suspension. Consequently, the handles with the respective related handle suspensions can easily be arranged, with respect to the operational axis at the height of the drive assembly, which includes an impact device, a drive motor, and, if necessary, a transmission, which can be accommodated in an interior of the housing. Since the handle suspensions in certain regions can be extended around the drive assembly, the handle suspensions can be so arranged in the housing in such a way that they will not cause or cause only a minor additional constructional length. In this way, a compact hand-held power tool is obtained in spite of the spring-loaded suspension of both handles, which can be handled comfortably.

According to an advantageous embodiment of the present invention, a first damping body is provided between the first handle suspension and the second handle suspension, which forms a first end stop against which the first handle suspension can be put up and a second end stop against which the second handle suspension can be put up. Consequently, at extreme load conditions of the hand-held power tool, at which a pivot range of the handle suspensions provided for isolating the vibration can be exceeded, the pivot range is limited by a damping end stop. Consequently, in the case of extreme loads, only noticeably reduced vibrations are transmitted from the hand-held power tool to the handle.

Advantageously, both a pivot motion of the first handle suspension and a pivot motion of the second handle suspension in both directions are limited by the damping body, as a result of which both end stops of the handle suspensions have damping properties, which reduces the energy of the vibrations which are transferred to the handles in the case of extreme loads.

Advantageously, the damping body is diamond-shaped in cross-section, as a result of which the handle suspensions in both directions can be put up against opposite surfaces of the one-piece damping body. In this way, handle suspensions can support each other on both sides of the end stops by using washers as damping bodies and, thus, reducing energy. Furthermore, this produces a highly compact and stable form of the damping body.

Advantageously, the handle suspensions each include a fork-shaped support which is connected, at a first side of the drive assembly and at a second side of the drive assembly opposite the first side, respectively, with a pivot support around a respective pivot axis. In this way, the handles can be so arranged that they intersect in the longitudinal direction of the operational axis. The two-side encompassing of the drive assembly provides for a particular stable pivotal support of the handle suspensions with respect to the remainder of the hand-held power tool.

Advantageously, the pivot axes are spaced from respective effective application points, at which a contract pressure is applied by the operator to the respective handle, by a distance of 13 to 19 cm. The effective application point, for example, essentially corresponds to a geometric center of the handle. Consequently, this produces a comfortable holding of the hand-held power tool with good vibration reduction at the handles. By maintaining a distance in the range between 15 and 18 cm, the vibration transmission to the handles can be reduced to a minimum intensity.

Advantageously, elastomer rings are provided between the pivot axes and the handle suspensions, respectively, whereby a primary vibration transmission to the handle assembly can be markedly reduced by the damping characteristics of the elastomer rings.

It is advantageous when there are provided a first damping body at the first side of the drive assembly and a second damping body at the second side of the drive assembly. This produces a two-part end stop for both handle suspensions in two pivot directions, respectively, which can be arranged geometrically. In this way, the forces or torques to be absorbed by the handle suspensions can be reduced considerably.

In a particularly advantageous embodiment, the spring means includes two helical springs, which are provided, transversely to the operational axis, respectively, between spring supports, which are solidly fixed to the housing, and a respective handle suspension. Consequently, only a very small additional construction space is required for the spring means, as the result of which a more compact design of the hand-held power tool is possible overall.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
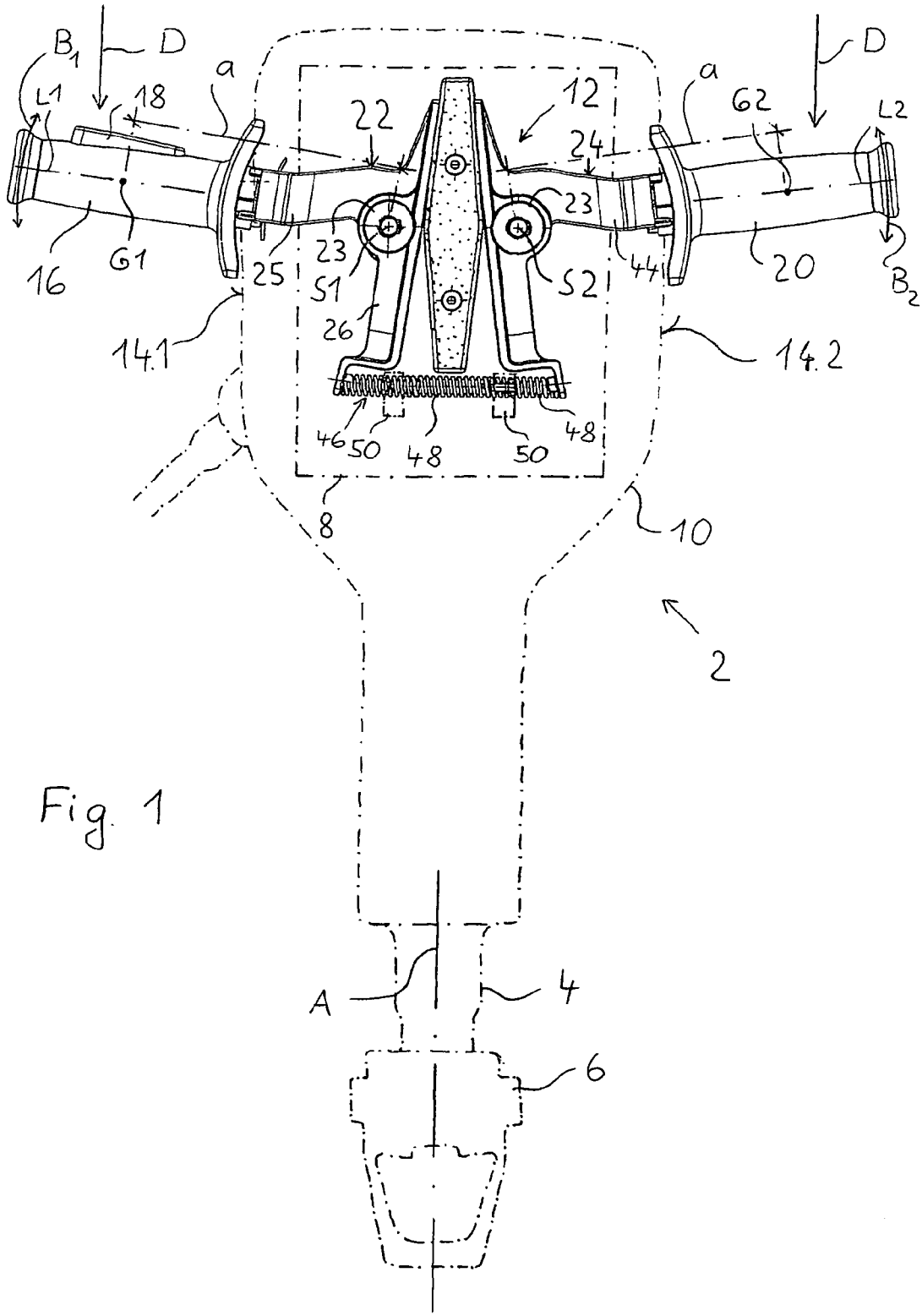
FIG. 1 shows a schematic view of a hand-held power tool with a vibration-reducing handle assembly according to the present invention.

FIG. 1 shows a portable hand-held power tool 2 in the form of an electropneumatically operated chisel hammer, which carries a tool holder 6 on a tool spindle 4 to which blows are imparted by a drive assembly 8, not shown in detail, along an operational axis A.

As an alternative to the design of the chisel hammer, the hand-held power tool 2 can also be formed as a drilling hammer or a combination chisel and drill hammer, in which the tool holder 6 in addition to being imparted with percussion motion, is also imparted with a rotating motion around the operational axis A. In this case, the drive assembly 8 comprises an additional transmission (not shown in detail).

The hand-held power tool 2 comprises a tool housing 10 in which the drive assembly 8 is located. Furthermore, a handle assembly 12 is provided, which comprises a first handle 16 projecting from a first side 14.1 of the housing 10, which is provided with a first effective point of application G1 which is formed by a geometric center of the handle. On the first handle 16, a push button 18 is provided for activating the drive assembly 8. Furthermore, the handle assembly 12 comprises a second handle 20 which projects from a second side 14.2 of the housing 10 opposite the first side 14.1 and defines a second effective point of application G2, which is formed by a geometric center of the handle.

Further, the first handle 16 is rotatable via a first handle suspension 22 around a first pivot axis S1, which is formed by a first pivot support 21.1, and the second handle 20 is rotatable via a second handle suspension 24 around a second pivot axis S2, which is formed by a second pivot support 21.2, along a path of motion B1 and B2, respectively. The pivot supports 21.1, 21.2 essentially are designed as pins solidly fixed to the housing, which project through the drive assembly 8. As an alternative to the illustrated embodiment, both handle suspensions 22, 24 can be pivotally supported on a common pivot support (not shown), which essentially is formed by a single pin projecting through the drive assembly 8.

A distance a between the first effective point of application G1 and the first pivot axis S1, as well as between a second effective point of application G2 and a second pivot axis S2 in this case amounts to between 13 and 19 cm, respectively, especially to 15 and 18 cm. Furthermore, vibration-damping elastomer rings 22 are provided between the pivot axes S1, S2 and the respective handle suspension 22, 24, as is illustrated in FIG. 2.

Figure 2:
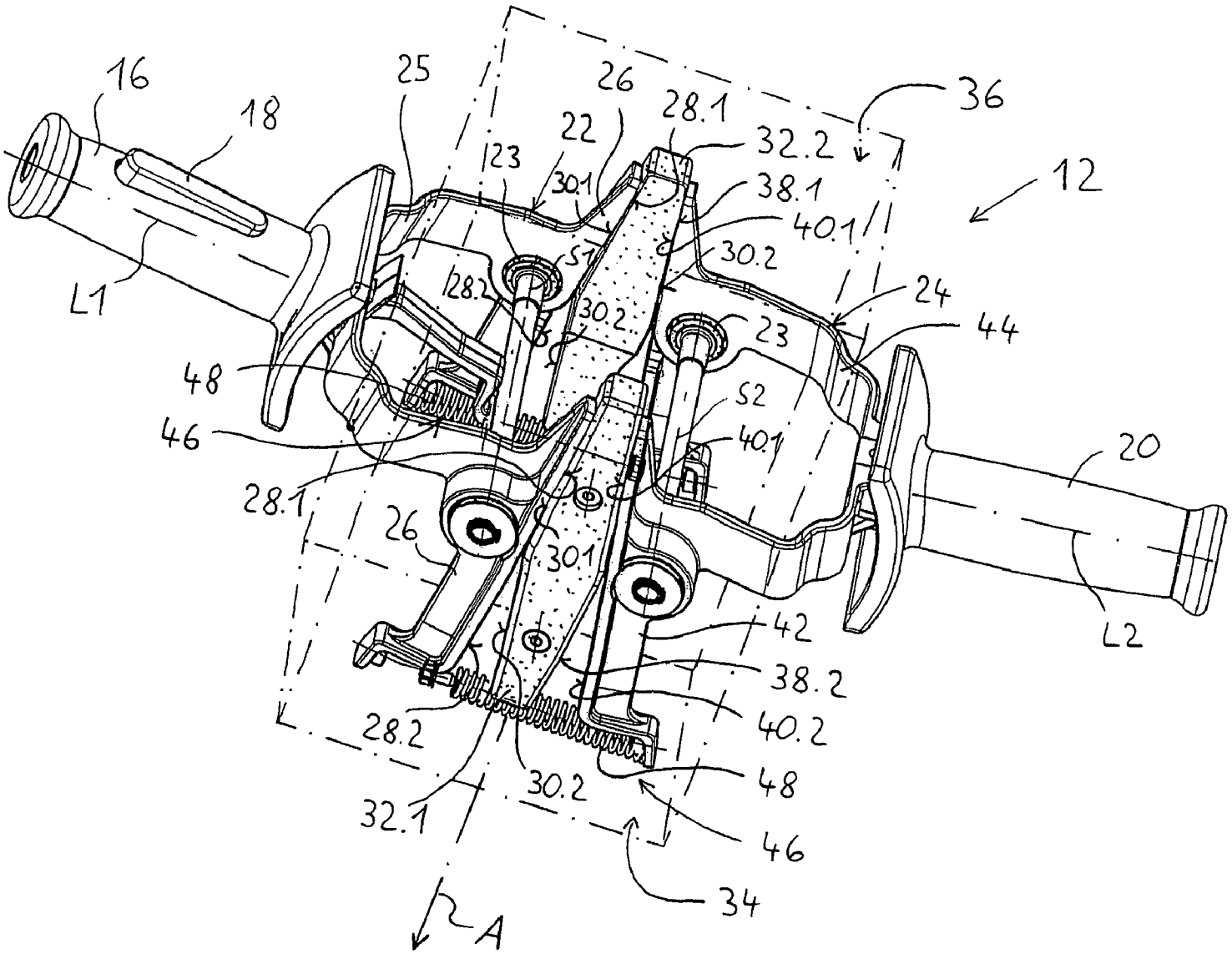
FIG. 2 shows a perspective view of the handle assembly according to FIG. 1.

Furthermore, as is disclosed especially in FIG. 2, the first handle suspension 22 comprises a fork-shaped branching first support 25 at the ends of which two first application arms 26 are provided. These first application arms 26 essentially extend transversely to a longitudinal axis L1 of the first handle 16 and form an upper application region 28.1 and a lower application region 28.2. The application regions 28.1, 28.2 abut, respectively, correspondingly arranged, first upper end stop surface 30.1 and a first lower end stop surface 30.2 of a first damping body 32.1 and a second damping body 32.2, which are made of elastomer. For this purpose, both damping bodies 32.1, 32.2 essentially are diamond-shaped, in which the first damping body 32.1 is positioned at a first side 34 of the drive assembly 8 and the second damping body 32.2 is positioned at a second side 36 of the drive assembly 8.

On the side remote from the handle suspension 22, the damping bodies 32.1, 32.2 also comprise second upper end stop surfaces 38.1 and second lower end stop surfaces 38.2 which corresponding upper application regions 40.1 and lower application regions 40.2 of the second handle suspension 24 abut. Further, the application regions 40.1, 40.2 are formed on second application arms 42 and are held, at the ends of a fork-shaped branched second support 44, essentially transversely to a longitudinal axis L2 of the second handle 20.

Furthermore, a helical spring 48 of spring means 46 engages, respectively, at least one of the first application arms 26 and at least one of the second application arms 42. As shown in FIG. 1, the helical spring 48 extends transverse to the operational axis A and is supported on spring supports 50 fixedly secured to the housing. As an alternative, the helical springs 48 at both ends can be supported at one of the handle suspensions 22, 24. In each case, the handle suspensions 22, 24, or rather the handles 16, 20 attached thereto, are preloaded in an initial position, in which, for example, the upper application regions of application 28.1, 40.1 abut the upper end surface 30.1, 38.1, as shown in FIGS. 1 and 2.

During the operation, a contact pressure D is applied in the direction of the operational axis A, while at the same time, the drive assembly 8 is actuated via the push button 18. The pulse-like application of blows to the tools spindle 4 and holding fixture 6, as well as the counter forces generated by a to-be-treated workpiece (not shown) generate vibrations in the hand-held power tool 2, which, in particular, act in the direction of the operational axis A.

The vibration-damping elastomer rings between the pivot axes S1, S2 and the handle suspensions 22, 24 ensure a reduced primary vibration transmission to the handles 16, 20.

The spring means 46 are so designed that with a regular contact pressure D, all application arms 26, 42 are spaced from respective end stop surfaces 30.1, 30.2, 38.1, 38.2, and both handle suspensions 22, 24 are able to rotate freely around the respective pivot axes S1 or S2 along the respective paths of motion B1, B2, in order to uncouple the handles 16, 20 from the housing 10 in terms of the vibrations occurring along the operational axis A.

In exceptional cases, at a particularly high contact pressure D or particularly high reaction forces of the treated workpieces, the paths of motion B1, B2 are extended by the stronger vibrations to such an extent that the upper application regions 28.1, 40.1 ultimately come in contact with the lower application regions 28.2, 40.2 at the respective damping bodies 32.1, 32.2. Also in this case, the vibrations, which are transmitted from the housing 10 or from the drive assembly 8, to the handle assembly 12, are noticeably reduced by the damping effect of the damping bodies 32.1, 32.2.

The essentially diamond-shaped form of the damping bodies 32.1, 32.2 and the matching shape of the application arms 26, 42 result in the upper application regions 28.1, 40.1 being simultaneously pressed against the upper end stop surfaces 32.1, 38.1 and the lower application regions 28.2, 40.2 being pressed simultaneously against the lower end stop surfaces 32.2, 38.2.

This has the effect that the press-on forces of both handle suspensions 22, 24, depending on the nature and positioning of the damping bodies 32.1, 32.3, cancel each other out.

Further, the fork shape of the supports 25, 44 enable an optimized positioning of the handles 16, 20 with stable mounting. The axial positioning at the height of the drive assembly 8 provides for a compact form and a good balance of the hand-held power tool 2. The radial distance of the effective points of application G1, G2 of 15 to 18 cm to the respective pivot axis S1, S2 guarantees a particularly low vibration transmission.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be ended to the disclosed embodiment or details thereof, and the present invention includes all variations and/or alternative embodiments within the spirit and scope of the present invention as defined by the appended claims.

What is claimed is:

1. A portable hand-held power tool (2), comprising:

a housing (10);

a drive assembly (8) located in housing (10) for driving a tool spindle (4) extending along an operational axis (A), a first handle (16) rotatable around a first pivot axis (S1) and a second handle (20) rotatable around a second pivot axis (S2), the first and second handles (16, 20) being arranged on the opposite sides (14.1, 14.2) of the housing (10);

first (22) and second (24) handle suspensions for rotating, respectively, the first (16) and second (20) handles about the first (S1) and second (S2) pivot axes, respectively, the first handle suspension (22) and the second handle suspension (24) partially extending circumferentially around the drive assembly (8); and spring means (46) for biasing the first and second handles (16, 20) to an initial position thereof, wherein between the first handle suspension (22) and the second handle suspension (24), a first damping body (32.1; 32.2) is provided which forms a first end stop (30.1; 30.2) and a second end stop (38.1; 38.2), against which the first (22) and the second (24) handle suspensions are put up, and wherein the first damping body (32.1, 32.2) limits a pivot motion of the first handle suspension (22) and a pivot motion of the second handle suspension (24) in both pivot directions.

2. A hand-held power tool as defined in claim 1, wherein the damping body (32.1; 32.2) is diamond-shaped.

3. A hand-held power tool as defined in claim 1, wherein the handle suspensions (22, 24) each comprises a fork-shaped support (25, 44) that is respectively provided at a first side (34) of the drive assembly (8) and at a second opposite side (36) of the drive assembly (8) and is associated with a respective pivot support (21.1, 21.2) for rotation around the respective pivot axes (S1, S2).

4. A hand-held power tool as defined in claim 3, wherein the pivot axes (S1, S2) are spaced from respective effective points of application (G1, G2) of the respective handles (16, 20) by a distance (a) from 13 to 19 cm.

5. A hand-held power tool as defined in claim 4, wherein the pivot axes (S1, S2) are spaced from respective effective points of application (G1, G2) of the respective handles (16, 20) by a distance (a) from 15 to 18 cm.

6. A hand-held power tool as defined in claim 3, wherein an elastomer ring (23) is provided between the pivot axes (S1, S2) and the handle suspensions 22, (24).

7. A hand-held power tool as defined in claim 3, wherein the first damping body (32.1) is positioned at a first side (34) of the drive assembly (8), and the second damping body (32.2) at a second side (36) of the drive assembly (8).

8. A hand-held power tool as defined in claim 1, wherein the spring means (46) comprises two helical springs (48) which extend transversally to the operational axis (A), and are arranged between a spring support (50) solidly fixed to the housing and a respective one of the handle suspensions (22, 24).

* * * * *